US008148898B2

(12) United States Patent
Yanagita et al.

(10) Patent No.: US 8,148,898 B2
(45) Date of Patent: Apr. 3, 2012

(54) PLASMA DISPLAY PANEL AND METHOD FOR MANUFACTURING PLASMA DISPLAY PANEL

(75) Inventors: Hideaki Yanagita, Miyazaki (JP); Takashi Sasaki, Hiratsuka (JP)

(73) Assignee: Hitachi, Ltd., Tokyo (JP)

( * ) Notice: Subject to any disclaimer, the term of this patent is extended or adjusted under 35 U.S.C. 154(b) by 98 days.

(21) Appl. No.: 12/740,678

(22) PCT Filed: Jun. 3, 2008

(86) PCT No.: PCT/JP2008/001396

§ 371 (c)(1),
(2), (4) Date: Apr. 29, 2010

(87) PCT Pub. No.: WO2009/147696

PCT Pub. Date: Dec. 10, 2009

(65) Prior Publication Data

US 2010/0295447 A1 Nov. 25, 2010

(51) Int. Cl.
*H01J 1/62* (2006.01)

(52) U.S. Cl. ..... 313/582; 313/584; 313/586

(58) Field of Classification Search ..... 313/582, 313/584, 586
See application file for complete search history.

(56) References Cited

U.S. PATENT DOCUMENTS

2002/0105270 A1 8/2002 Terao et al.
2005/0062422 A1 3/2005 Sasaki et al.

FOREIGN PATENT DOCUMENTS

JP 08-212918 A 8/1996
JP 2002-216635 A 8/2002
JP 2005-116508 A 4/2005
JP 2006-310162 A 11/2006

*Primary Examiner* — Vip Patel
(74) *Attorney, Agent, or Firm* — Miles & Stockbridge P.C.

(57) ABSTRACT

A plasma display panel includes a first and a second panel. The first panel includes a first plate provided with a plurality of display electrodes extending in a first direction. The second panel includes a second plate facing the first plate via a discharge space, a plurality of first barrier ribs provided on the second plate, and a dent part opened to a side of the first plate. The dent part is provided in between the barrier ribs adjacent to each other. A width of the dent part along the first direction is formed to be narrower toward a side of the second plate from the side of the first plate for at least within a range from a position at a half of a depth to a bottom part of the dent part. As a result, a luminescent efficiency of the PDP can be improved.

6 Claims, 10 Drawing Sheets

| | c1 | c2 | c3 |
|---|---|---|---|
| PR [MPa] | 0.15 | 0.3 | 0.15 |
| S10 [μm] | 3~5 | 3~5 | 2~4 |
| T10 [h] | 1 | 1 | 1 |
| W10 | 1 | 1 | 1 |
| W20 | 0.75 | 0.7 | 0.95 |
| W30 | 0.6 | 0.55 | 0.7 |
| DP | 1.3 | 1.9 | 1.25 |

| | c1 | c2 | c3 |
|---|---|---|---|
| PR [MPa] | 0.15 | 0.3 | 0.15 |
| S10 [μm] | 3~5 | 3~5 | 2~4 |
| T10 [h] | 1 | 1 | 1 |
| W12 | 1 (2.2) | 1 (2.2) | 1 (2.2) |
| W22 | 0.75 (1.65) | 0.7 (1.55) | 0.93 (2.05) |
| W32 | 0.59 (1.3) | 0.54 (1.2) | 0.68 (1.5) |
| DP | 0.59 (1.3) | 0.86 (1.9) | 0.57 (1.25) |

PLASMA DISPLAY PANEL AND METHOD FOR MANUFACTURING PLASMA DISPLAY PANEL

TECHNICAL FIELD

The present invention relates to a plasma display panel and a manufacturing method thereof.

BACKGROUND ART

A plasma display panel (PDP) is made up by adhering two pieces of glass plates (a front glass plate and a back glass plate) with each other, and displays an image by generating a discharge in a space (discharge space) formed between the glass plates. A cell corresponding to a pixel in the image is a self-luminescence type, and phosphors emitting visible lights of red, green, and blue by receiving ultraviolet ray generated by the discharge are coated thereon. One pixel is made up of three cells emitting the visible lights of these red, green, and blue.

For example, a PDP in three-electrode structure displays an image by generating a sustain discharge between an X electrode and a Y electrode. The cell in which the sustain discharge is generated (the cell to be lighted) is selected by, for example, selectively generating an address discharge between the Y electrode and an address electrode.

In general, the front glass plate has the X electrodes and the Y electrodes, and the back glass plate has barrier ribs extending in an orthogonal direction of the X electrodes. The above-stated phosphors are coated on a side surface and a bottom surface of a groove (dent part) formed by the barrier ribs (for example, refer to Patent Document 1). For example, a cross section of the dent part to which the phosphor is coated is formed to be a form near a rectangle.

Patent Document 1: Japanese Unexamined Patent Application Publication No. 2005-116508

DISCLOSURE

Problems to be Solved

In the PDP of which form inside the dent part is near the rectangle, for example, there is a possibility that the sustain discharge does not spread to a vicinity of a corner of the bottom surface side of the dent part because the spread of the sustain discharge is limited by the side surface of the dent part. In this case, it is difficult to effectively emit the visible light from the phosphor coated in the vicinity of the corner of the bottom surface side of the dent part. When the sustain discharge is spread to the vicinity of the corner of the bottom surface side of the dent part to improve a luminescent efficiency of the PDP, for example, the discharge stronger than the discharge in the vicinity of the corner of the dent part is generated in a vicinity of the side surface near an opening part of the dent part. Accordingly, the phosphor coated at the side surface of the dent part deteriorates earlier than the phosphor coated in the vicinity of the corner of the dent part. In this case, an operating life of the PDP is shortened because an operating life of the phosphor coated at the side surface of the dent part is shortened.

A proposition of the present invention is to improve the luminescent efficiency of the PDP. In particular, the proposition of the present invention is to improve the luminescent efficiency of the PDP while suppressing the deterioration of the phosphor.

Means for Solving the Problems

A plasma display panel includes a first and a second panel. The first panel includes a first plate provided with a plurality of display electrodes extending in a first direction. The second panel includes a second plate facing the first plate via a discharge space, a plurality of first barrier ribs provided on the second plate, and a dent part opened to a side of the first plate. For example, the first barrier ribs are arranged on the second plate along the first direction and extended in a second direction intersecting with the first direction. Besides, the dent part is provided in between the barrier ribs adjacent to each other. A width of the dent part along the first direction is formed to be narrower toward a side of the second plate from the side of the first plate for at least within a range from a position at a half of a depth to a bottom part of the dent part.

Effect

According to the present invention, a luminescent efficiency of a PDP can be improved. In particular, in the present invention, it is possible to improve the luminescent efficiency of the PDP while suppressing the deterioration of the phosphor.

DETAILED DESCRIPTION OF THE EMBODIMENTS

Hereinafter, embodiments of the present invention are described by using the drawings.

Figure 1:
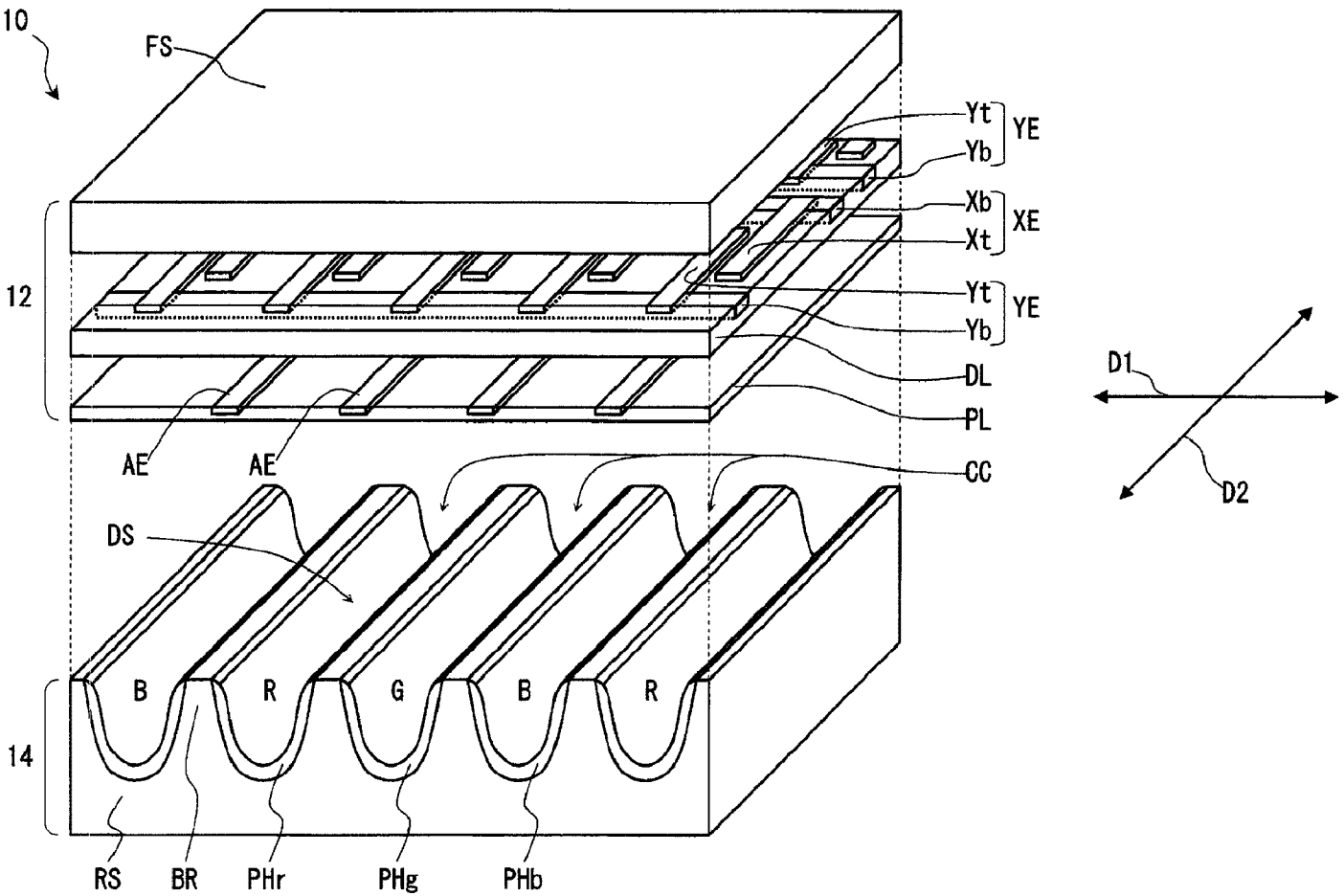
FIG. 1 is a view illustrating a substantial part of a PDP according to an embodiment.

FIG. 1 illustrates a substantial part of a plasma display panel (hereinafter, also referred to as a PDP) according to an embodiment of the present invention. An arrow D1 in the drawing represents a first direction D1, and an arrow D2 represents a second direction D2 which is in orthogonal to the first direction D1 within a surface in parallel with an image display surface. A PDP 10 is made up of a front plate part 12 (a first panel) making up the image display surface, and a back plate part 14 (a second panel) facing the front plate part 12. A discharge space DS is formed between the front plate part 12 and the back plate part 14 (in more detail, in dent parts CC where phosphors PH (PHr, PHg, PHb) are coated at the back plate part 14).

The front plate part 12 includes plural X bus electrodes Xb and Y bus electrodes Yb provided on a surface (a lower side in the drawing) of a glass base FS (a first plate) facing a glass base RS (a second plate), to extend in the first direction D1 and disposed with intervals from one another. Besides, an X transparent electrode Xt extending from the X bus electrode Xb to the Y bus electrode Yb in the second direction D2 is coupled to the X bus electrode Xb. A Y transparent electrode Yt extending from the Y bus electrode Yb to the X bus electrode Xb in the second direction D2 is coupled to the Y bus electrode Yb. In the example in the drawing, the X transparent electrode Xt and the Y transparent electrode Yt face along the second direction D2. Incidentally, the transparent electrodes Xt, Yt may be provided to face along the first direction D1, or may be provided to face along a diagonal direction relative to the first direction D1 (or the second direction D2).

For example, the X bus electrode Xb and the Y bus electrode Yb are opaque electrodes formed by a metal material and so on, and the X transparent electrode Xt and the Y transparent electrode Yt are transparent electrodes transmitting visible light formed by an ITO film and so on. An X electrode XE (display electrode) is made up of the X bus electrode Xb and the X transparent electrode Xt, and a Y electrode YE (display electrode) is made up of the Y bus electrode Yb and the Y transparent electrode Yt, to be a pair with the X electrode XE. A discharge (sustain discharge) is repeatedly generated between the X electrode XE and the Y electrode YE paired with each other (more specifically, between the X transparent electrode Xt and the Y transparent electrode Yt).

Incidentally, the transparent electrodes Xt and Yt may be disposed on a whole surface between the bus electrodes Xb and Yb to which they each are coupled and the glass base FS. Besides, electrodes made up of the same material (metal material and so on) with the bus electrodes Xb and Yb and to be integrated with the bus electrodes Xb and Yb may be formed instead of the transparent electrodes Xt and Yt.

The electrodes Xb, Xt, Yb, Yt are covered by a dielectric layer DL. For example, the dielectric layer DL is an insulating film such as a silicon dioxide film formed by a CVD method. Plural address electrodes AE extending in an orthogonal direction with the bus electrodes Xb, Yb (second direction D2) are provided on the dielectric layer DL (at a lower side in the drawing). As stated above, the front plate part 12 includes the glass base FS where the plural electrodes XE, YE (display electrodes) extending in the first direction D1 and the plural address electrodes AE extending in the second direction D2 are provided.

The address electrodes AE and the dielectric layer DL are covered by a protective layer PL. For example, the protective layer PL is formed by an MgO film of which emission characteristic of secondary electrons resulting from collisions of positive ions is high, so as to generate the discharge easily.

The back plate part 14 includes the glass base RS (second plate) facing the glass base FS via the discharge space DS. Plural barrier ribs BR (first barrier ribs) extending in the second direction D2 intersecting with the first direction D1 are arranged along the first direction D1 on the glass base RS (the glass base FS side of the glass base RS). Namely, the back plate part 14 facing the front plate part 12 via the discharge space DS includes the plural barrier ribs BR formed on the glass base RS in parallel with each other and extending in the direction (second direction D2) orthogonal with the bus electrodes Xb, Yb. For example, in the present embodiment, the barrier rib BR is integrally formed with the glass base RS. In this case, the glass base RS at a portion positioning at the glass base FS side compared to the bottom part of the dent part CC is called as the barrier rib BR.

The dent part CC is formed by the barrier rib BR integrally provided with the glass base RS at a surface side of the back plate part 14 facing the front plate part 12. Namely, the dent part CC opening to the front plate part 12 side is provided between the barrier ribs BR adjacent to each other. Incidentally, a width of the dent part CC along the first direction D1 is formed to be narrower as it goes from an opening part to the bottom part, as illustrated in later-described FIG. 2. Besides, when it is seen from the second direction D2, the bottom part of the dent part CC is formed in an arc state. Note that the bottom part of the dent part CC may be formed in a line state when it is seen from the second direction D2.

Besides, a sidewall of a cell is made up of the barrier rib BR. The phosphors PHr, PHg, PHb emitting visible lights of red (R), green (G), and blue (B) as a result of being excited by ultraviolet ray are each coated on the side surface of the barrier rib BR and the glass base RS between the barrier ribs BR adjacent to each other. Namely, the plural kinds of phosphors PHr, PHg, PHb emitting lights of different colors from one another are each provided on the surfaces inside the dent parts CC. Hereinafter, the phosphors PHr, PHg, PHb are referred to as the phosphor PH when it is not distinguished by each color of the visible light and so on.

One pixel of the PDP 10 is made up of the three cells emitting lights of red, green, and blue. Here, one cell (a pixel of one color) is formed at an area surrounded by, for example, the bus electrodes Xb, Yb, and the barrier ribs BR. As stated above, the PDP 10 is made up by disposing the cells in a matrix state, and by arranging plural kinds of cells emitting different colors of lights from one another alternately to display a color image. A display line is made up of the cells formed along the bus electrodes Xb, Yb though it is not illustrated in particular.

The PDP 10 is made up by adhering the front plate part 12 and the back plate part 14 so that the protective layer PL and the barrier ribs BR are brought into contact with each other, and encapsulating discharge gas such as Ne, Xe in the discharge space DS.

Figure 2:
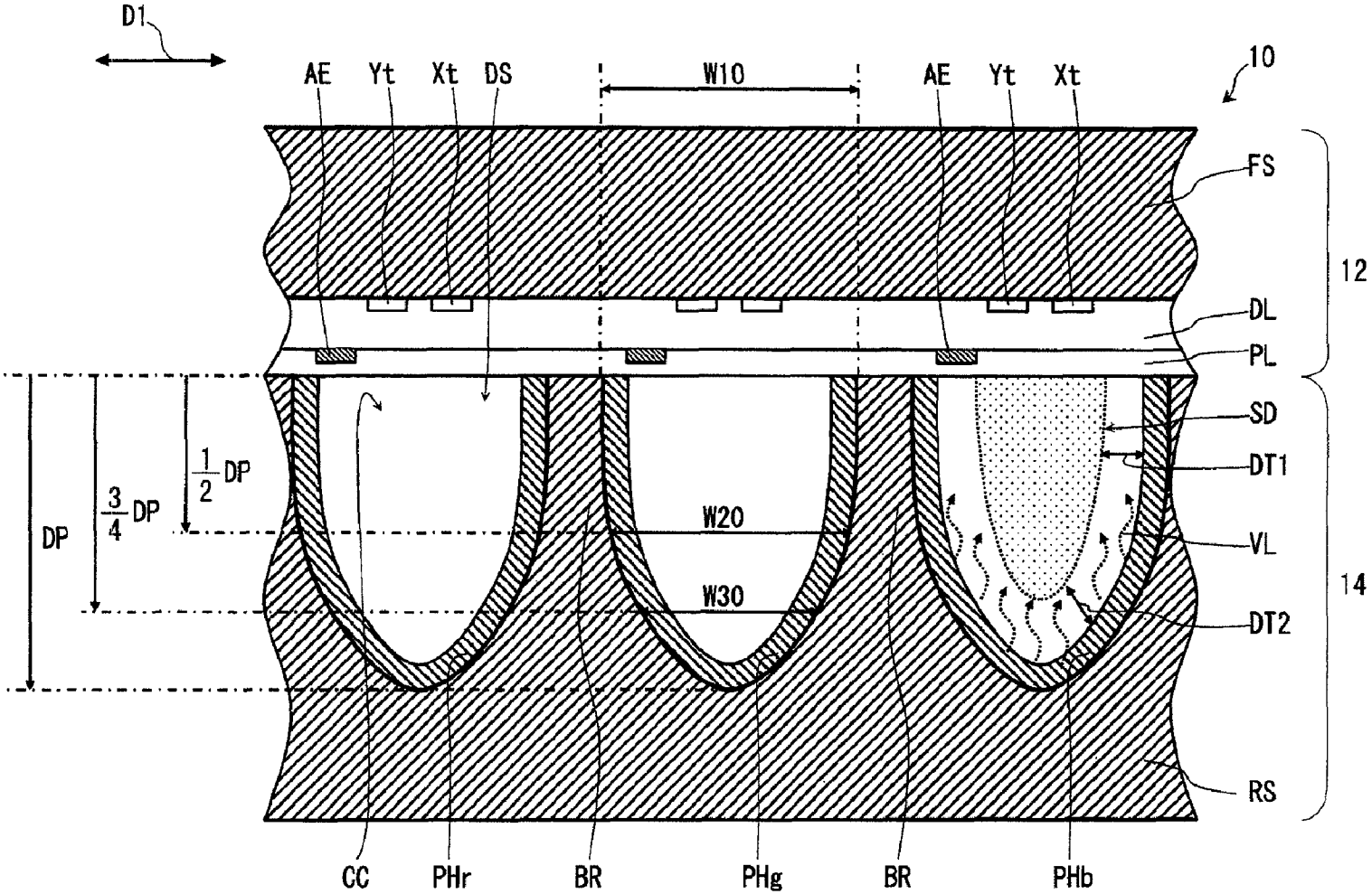
FIG. 2 is a view illustrating a cross section of the PDP illustrated in FIG. 1 along a first direction.

FIG. 2 illustrates a cross section of the PDP 10 illustrated in FIG. 1 along the first direction D1. Note that FIG. 2 illustrates a cross section at a position where the X transparent electrode Xt and the Y transparent electrode Yt face with each other (a cross section between the bus electrode Xb and the bus electrode Yb paired with each other). A meaning of the arrow D1 in the drawing is the same as that of the above-stated FIG. 1. Besides, a half-tone dot meshing portion in the drawing represents a sustain discharge SD generated between the transparent electrodes Xt, Yt.

In the present embodiment, a depth DP of the dent part CC is larger than a width W10 at the opening part of the dent part CC along the first direction D1. As stated above, in the present embodiment, a discharge efficiency is improved by deepening the depth DP of the dent part CC. Besides, the width of the dent part CC along the first direction D1 is formed to be narrower as it goes from the opening part toward the bottom part as stated above. For example, the width W10 at the opening part of the dent part CC along the first direction D1 is larger than a width W20 at a half of the depth of the dent part CC (½·DP) along the first direction D1, and the width W20 is larger than a width W30 at a depth of three fourths of the dent part CC (¾·DP) along the first direction D1.

As stated above, in the present embodiment, the width of the dent part CC along the first direction D1 is formed to be narrower as it goes from the glass base FS side to the glass base RS side at least within a range from the position at the half of the depth DP (½·DP) to the bottom part of the dent part CC. Accordingly, in the present embodiment, for example, a difference between a distance DT1 and a distance DT2 can be made small, and the sustain discharge SD can be spread to a whole of the discharge space DS. Here, for example, the distance DT1 is a distance between a surface of a phosphor PH provided at a position near from between the transparent electrodes Xt, Yt and a generation area of the sustain discharge SD (discharge position), and the distance DT2 is a distance between a surface of a phosphor PH provided at a position far from between the transparent electrodes Xt, Yt and the generation area of the sustain discharge SD.

In the present embodiment, it is possible to efficiently emit a visible light VL from the phosphor PH provided at the position far from between the transparent electrodes Xt, Yt and to improve an luminescent efficiency of the PDP 10 because the difference between the distance DT1 and the distance DT2 can be made small. Besides, in the present embodiment, it is possible to prevent only the phosphor PH at a certain position (for example, at a position near from between the transparent electrodes Xt, Yt) from deteriorating and to elongate the operating life of all of the phosphors PH because the sustain discharge SD can be spread to the whole of the discharge space DS. Namely, in the present embodiment, it is possible to improve a luminescent efficiency of the PDP while suppressing the deterioration of the phosphors PH.

Besides, in the present embodiment, it is possible to reduce the visible light VL emitted in a direction in parallel with the glass base FS (visible light which does not contribute to the display) because the width of the dent part CC along the first direction D1 is formed to be narrower as it goes from the glass base FS side to the glass base RS side. Namely, in this embodiment, it is possible to increase an amount (surface area) of the phosphor PH emitting the visible light VL at the glass base FS side and to increase an amount of the visible light VL reaching the glass base FS. Accordingly, the luminescent efficiency of the PDP 10 can be improved, and luminance of an image displayed on the PDP 10 can be made high.

Figure 3:
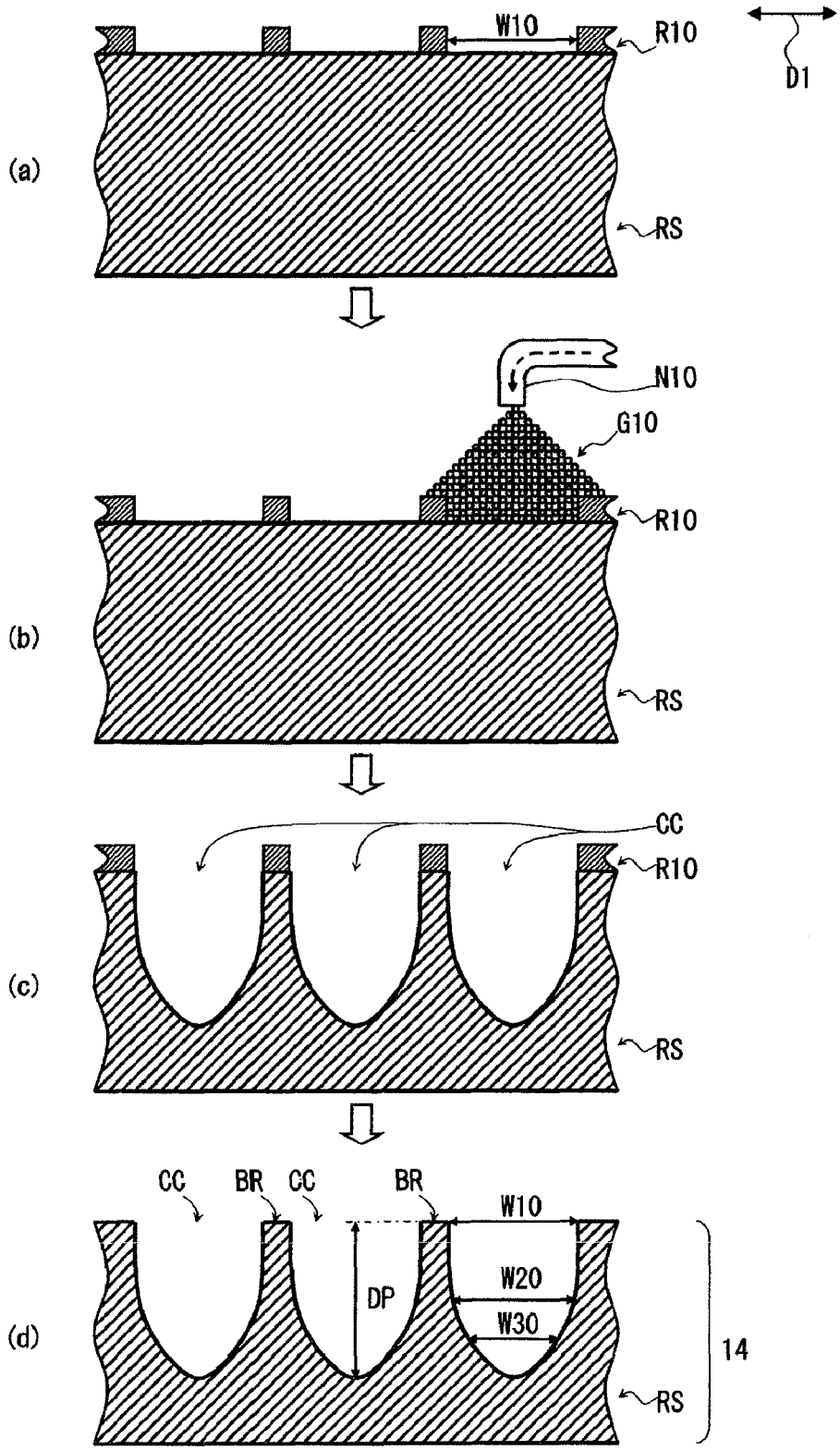
FIG. 3 are views illustrating an example of a manufacturing method of dent parts illustrated in FIG. 2.

FIG. 3 illustrate an example of a manufacturing method of the dent part CC illustrated in FIG. 2. Note that FIG. 3 illustrate cross sections of the back plate part 14 (the glass base RS and the barrier ribs BR) along the first direction D1 until the dent parts CC are formed. The meaning of the arrow D1 in the drawing is the same as that of the above-stated FIG. 1.

At first, photo resists R10 each having a pattern of a top part of the barrier rib BR are formed on the glass base RS (FIG. 3(*a*)). Namely, the photo resists R10 are provided on the glass base RS at portions except areas where the opening parts of the dent parts CC are formed. Next, an abrasive G10 is sprayed from a nozzle gun N10 of a sand blast device toward the glass base RS (FIG. 3(*b*)). The glass base RS at a portion where the abrasive G10 is sprayed (for example, a portion not covered by the photo resists R10) is removed by the sand blast (FIG. 3(*c*)). Incidentally, the depth DP, the widths W10, W20, W30 and so on of the dent part CC can be adjusted by adjusting conditions of the sand blast such as a spraying pressure of the nozzle gun N10, a grain diameter of the abrasive G10, as illustrated in later-described FIG. 4. Finally, the photo resists R10 are removed, and the barrier ribs BR and the dent parts CC are formed (FIG. 3 (*d*)).

Figure 4:
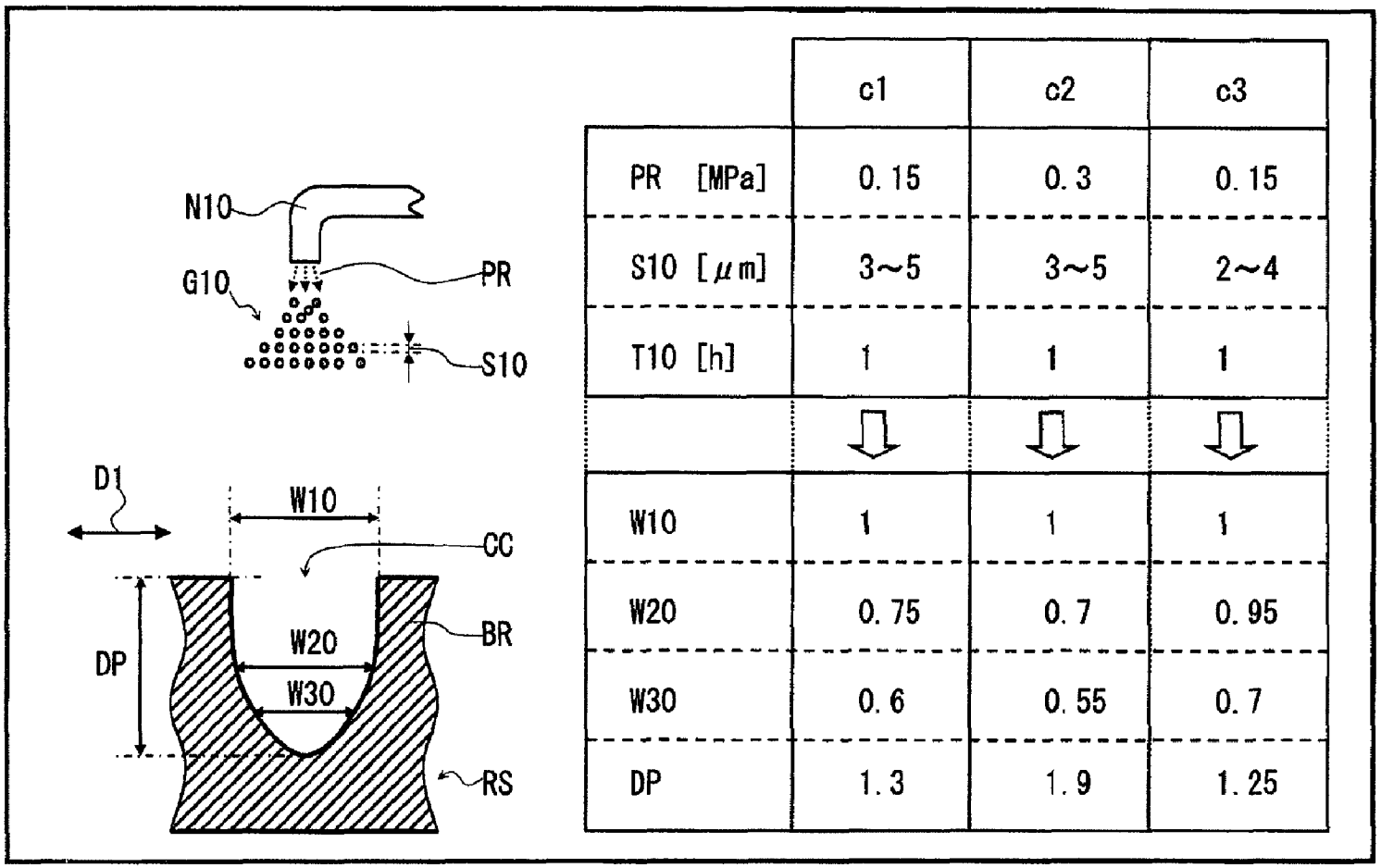
FIG. 4 is a view illustrating an example of a relation between conditions of a sand blast of the manufacturing method illustrated in FIG. 3 and a form of the dent part.

FIG. 4 illustrates an example of a relation between the conditions of the sand blast in the manufacturing method illustrated in FIG. 3 and the forms of the dent part CC. Note that the widths W10, W20, W30 and the depth DP in the drawing represent relative values for the width W10 at the opening part of the dent part CC. In a condition c1 of the sand blast, a spraying pressure PR of the nozzle gun N10 is 0.15 MPa, an abrasive grain diameter S10 (grain diameter S10 of the abrasive G10) is 3 μm to 5 μm, and a process time (spraying time) T10 is for one hour. In a condition c2, the spraying pressure PR is 0.3 MPa, the abrasive grain diameter S10 is 3 μm to 5 μm, and the process time T10 is for one hour. In a condition c3, the spraying pressure PR is 0.15 MPa, the abrasive grain diameter S10 is 2 μm to 4 μm, and the process time T10 is for one hour.

In the condition c1, the width W20 at the half of the depth of the dent part CC (½·DP) is formed to be approximately 0.75 times of the width W10 at the opening part of the dent part CC, and the width W30 at the three fourths of the dent part CC (¾·DP) is formed to be approximately 0.6 times of the width W10 at the opening part of the dent part CC. Besides, the depth DP of the dent part CC is formed to be approximately 1.3 times of the width W10 at the opening part of the dent part CC. For example, when the width W10 at the opening part of the dent part CC is 200 μm, the width W20 is approximately 150 μm, the width W30 is approximately 120 μm, and the depth DP is approximately 260 μm.

In the condition c2, the width W20 is formed to be approximately 0.7 times of the width W10, the width W30 is formed to be approximately 0.55 times of the width W10, and the depth DP is formed to be approximately 1.9 times of the width W10. For example, when the width W10 is 200 μm, the width W20 is approximately 140 μm, the width W30 is approximately 110 μm, and the depth DP is approximately 380 μm. As stated above, under the condition c2 of which spraying pressure PR is large, the depth DP of the dent part CC is formed to be larger compared to the condition c1. Namely, the depth DP of the dent part CC can be deepened by making the spraying pressure PR large. Note that in the present embodiment, the width of the dent part CC along the first direction D1 is formed to be narrower as it goes from the opening part to the bottom part, and therefore, it is possible to easily form the deep dent part CC (and high barrier rib BR). Accordingly, in the present embodiment, the discharge space DS can be easily made large by deepening the depth DP of the dent part CC.

In the condition c3, the width W20 is formed to be approximately 0.95 times of the width W10, the width W30 is formed to be approximately 0.7 times of the width W10, and the depth DP is formed to be approximately 1.25 times of the width W10. For example, when the width W10 is 200 μm, the width W20 is approximately 190 μm, the width W30 is approximately 140 μm, and the depth DP is approximately 250 μm. As stated above, under the condition c3 of which abrasive grain diameter S10 is small, the difference between the width W10 at the opening part of the dent part CC and the width W20 at the half of the depth of the dent part CC (½·DP) is formed to be smaller compared to the condition c1. Namely, a variation of the width along the first direction D1 (for example, the difference between the width W10 and the width W20) can be made small within a range from the opening part of the dent part CC to the half of the depth of the dent part CC (½·DP) by making the abrasive grain diameter S10 small.

Figure 5:
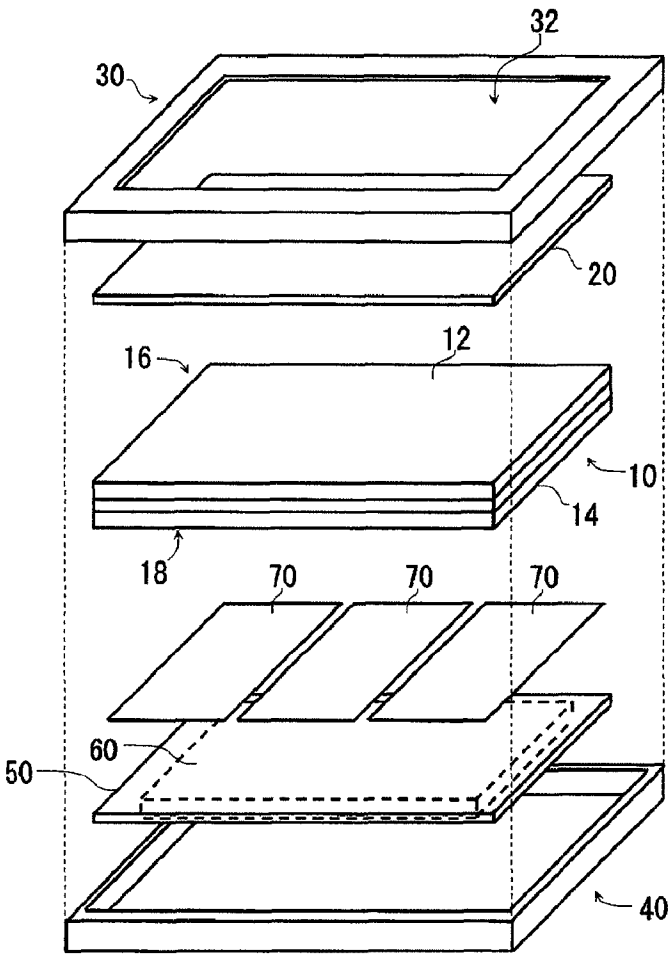
FIG. 5 is a view illustrating an example of a plasma display device made up by using the PDP illustrated in FIG. 1.

FIG. 5 illustrates an example of a plasma display device made up by using the PDP 10 illustrated in FIG. 1. The plasma display device (hereinafter referred to also as a PDP device) includes the PDP 10, an optical filter 20 provided at an image display surface 16 side (output side of light) of the PDP 10, a front case 30 disposed at the image display surface 16 side of the PDP 10, a rear case 40 and a base chassis 50 disposed at a back surface 18 side of the PDP 10, a circuit unit 60 attached at the rear case 40 side of the base chassis 50 to drive the PDP 10, and double-faced adhesive sheets 70 to adhere the PDP 10 to the base chassis 50. The circuit unit 60 is made up of plural components, and therefore, it is represented by a box in a dotted line in the drawing. The optical filter 20 is adhered to a protection glass (not-illustrated) attached to an opening part 32 of the front case 30. Incidentally, the optical filter 20 may have a function to shut out an electromagnetic wave. Besides, the optical filter 20 may be directly adhered to the image display surface 16 side of the PDP 10 instead of the protection glass.

As stated above, in the present embodiment, the width of the dent part CC along the first direction D1 is formed to be narrower as it goes from the opening part to the bottom part. Accordingly, in the present embodiment, it is possible to spread the sustain discharge SD to the whole of the discharge space DS, and to improve the luminescent efficiency of the PDP 10. Besides, in the present embodiment, it is possible to prevent that only the phosphors PH at certain positions (for example, at a position near from between the transparent electrodes Xt, Yt), and therefore, the operating life of all of the phosphors PH can be made long, and the operating life of the PDP 10 can be made long. Namely, in the present embodiment, the luminescent efficiency of the PDP can be improved while suppressing the deterioration of the phosphors PH.

Figure 6:
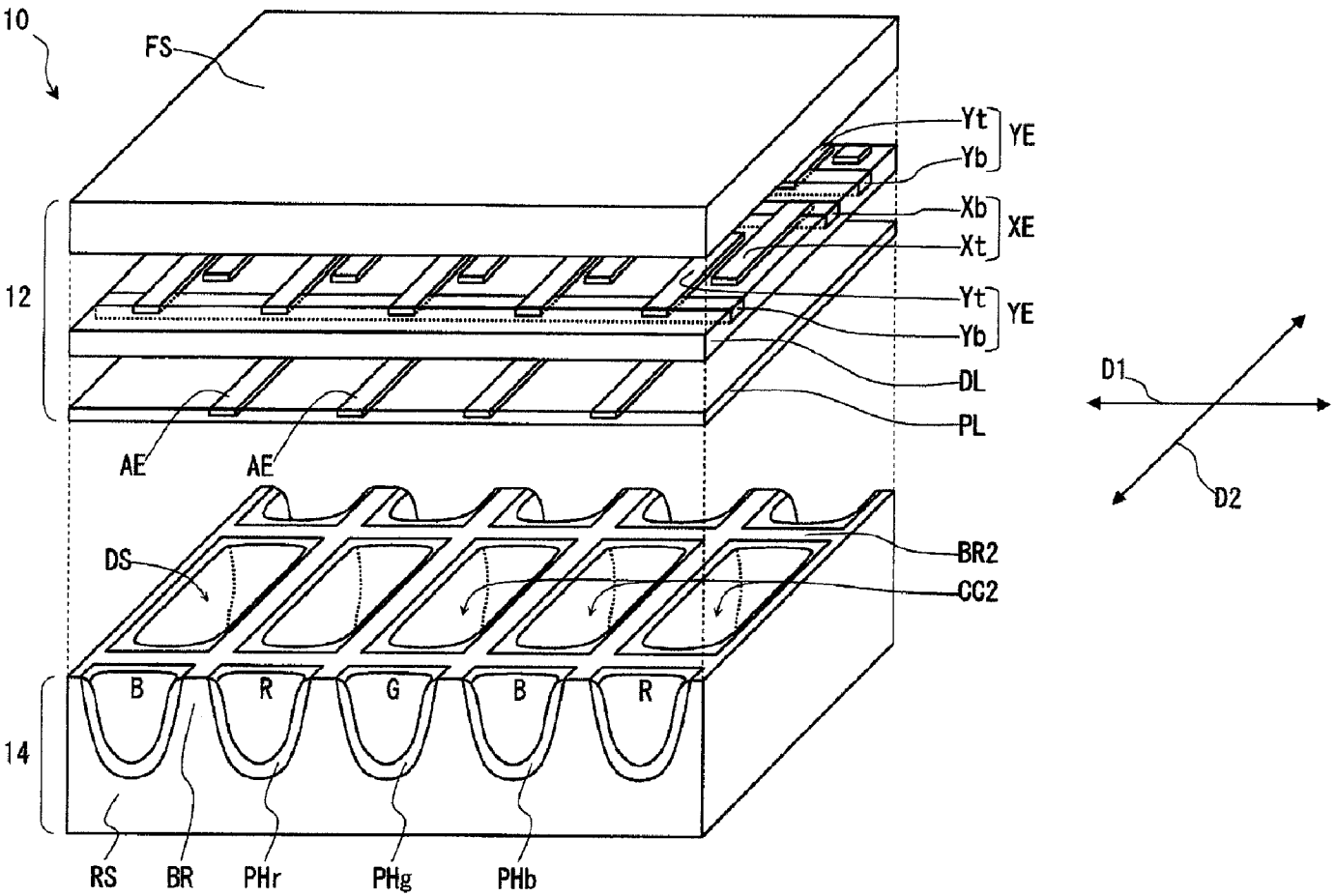
FIG. 6 is a view illustrating a substantial part of a PDP according to another embodiment.

FIG. 6 illustrates an outline of a PDP 10 in another embodiment. In this embodiment, the PDP 10 is made up by adding barrier ribs BR2 to the constitution illustrated in the above-stated FIG. 1. The other constitutions are the same as the embodiment described in FIG. 1 to FIG. 5. Incidentally, for example, a manufacturing method of dent parts CC2 is the same as the above-stated FIG. 3 except a pattern of the photo resists R10. The same reference numerals and symbols are used to designate the same and corresponding elements described in FIG. 1 to FIG. 5, and the detailed description thereof will not be given.

Barrier ribs in a grid state made up by the barrier ribs BR and the barrier ribs BR2 (second barrier rib) are formed on the glass base RS. Incidentally, each dent part CC illustrated in the above-stated FIG. 1 is separated by the barrier rib BR2 to be divided as the dent parts CC2. Namely, the back plate part 14 includes the plural barrier ribs BR2 provided to extend in the first direction D1 on the glass base RS, and dividing the dent parts CC illustrated in the above-stated FIG. 1. For example, in the present embodiment, the barrier rib BR2 is integrally formed with the glass base RS and the barrier rib BR. In this case, the glass base RS at a portion positioning at the glass base FS side compared to a bottom part of the dent part CC2 is called as the barrier rib BR or the barrier rib BR2.

A sidewall of the cell is made up of the barrier ribs BR, BR2. The phosphors PHr, PHg, PHb emitting the visible lights of red (R), green (G), blue (B) as a result of being excited by the ultraviolet ray are each coated on the side surfaces of the barrier ribs BR, BR2 and on the glass base RS at a portion surrounded by the barrier ribs BR, BR2. Namely, the plural kinds of phosphors PHr, PHg, PHb emitting lights of different colors from one another are each provided on the surfaces inside the dent parts CC2.

Figure 7:
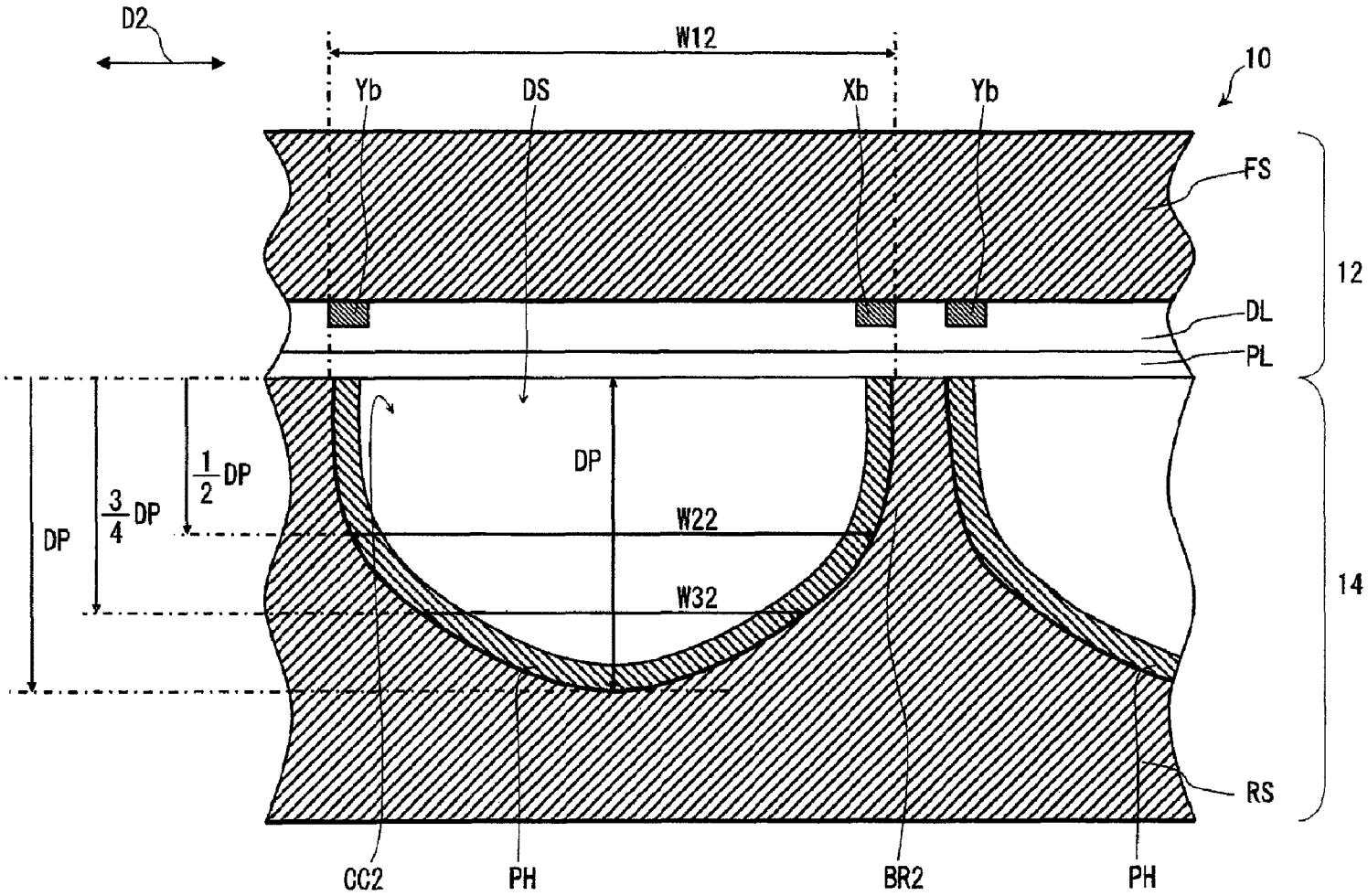
FIG. 7 is a view illustrating a cross section of the PDP illustrated in FIG. 6 along a second direction.

FIG. 7 illustrates a cross section of the PDP 10 illustrated in FIG. 6 along the second direction D2. Note that FIG. 7 illustrates the cross section between the X transparent electrode Xt and the Y transparent electrode Yt illustrated in FIG. 6. Besides, a cross section of the PDP 10 illustrated in FIG. 6 along the first direction D1 is the same as the above-stated FIG. 2, and therefore, the description thereof is not given.

A width of the dent part CC2 along the second direction D2 is formed to be narrower as it goes from the opening part to the bottom part. For example, a width W12 at the opening part of the dent part CC2 along the second direction D2 is larger than a width W22 at a half of a depth of the dent part CC2 (½·DP) along the second direction D2, and the width W22 is larger than a width W32 at a depth of three fourths of the dent part CC2 (¾·DP) along the second direction D2. Besides, in the present embodiment, a cross section of the bottom part of the dent part CC2 along the second direction D2 is formed in an arc state. Note that the cross section of the bottom part of the dent part CC2 along the second direction D2 may be formed in a line state.

As stated above, the width of the dent part CC2 along the second direction D2 is formed to be narrower as it goes from the glass base FS side to the glass base RS side at least within a range from the position at the half of the depth DP of the dent part CC2 (½·DP) to the bottom part. Accordingly, in the present embodiment, it is possible to spread the sustain discharge to the whole of the discharge space DS, and the luminescent efficiency of the PDP can be improved while suppressing the deterioration of the phosphors PH.

Figure 8:
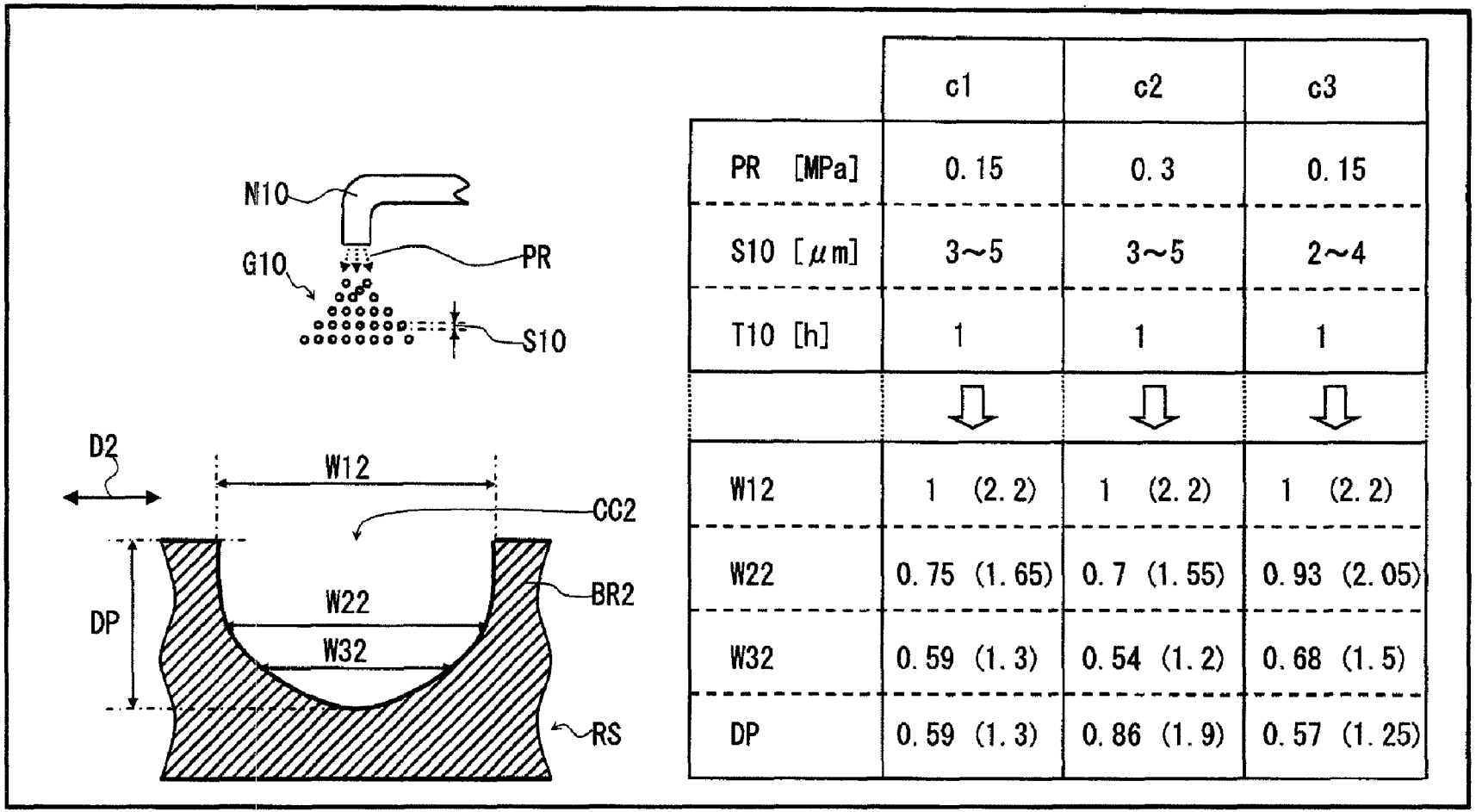
FIG. 8 is a view illustrating an example of a relation between the conditions of the sand blast of the manufacturing method illustrated in FIG. 3 and the form of the dent part illustrated in FIG. 7.

FIG. 8 illustrates an example of a relation between the conditions of the sand blast in the manufacturing method illustrated in FIG. 3 and the forms of the dent part CC2. Note that the widths W12, W22, W32 and the depth DP in the drawing represent relative values for the width W12 of at opening part of the dent part CC2 along the second direction D2. Besides, numerical values within parentheses represent relative values for the width W10 at the opening part of the dent part CC illustrated in the above-stated FIG. 2 to FIG. 4 (dent part CC2 in FIG. 7 and FIG. 8) along the first direction D1. The conditions c1, c2 c3 of the sand blast are the same as the above-stated FIG. 4.

In the condition c1, the width W22 at the half of the depth of the dent part CC2 (½·DP) is formed to be approximately 0.75 times of the width W12 at the opening part of the dent part CC2, and the width W32 at the three fourths of the depth of the dent part CC2 (¾·DP) is formed to be approximately 0.59 times of the width W12 at the opening part of the dent part CC2. Besides, the depth DP of the dent part CC2 is formed to be approximately 0.59 times of the width W12 at the opening part of the dent part CC2. For example, when a width at the opening part of the dent part CC2 along the first direction D1 (the width W10 of the dent part CC illustrated in the above-stated FIG. 4) is 200 μm, the width W12 is approximately 440 μm (2.2 times of the width W10). In this case, the width W22 is approximately 330 μm (1.65 times of the width W10), the width W32 is approximately 260 μm (1.3 times of the width W10), and the depth DP is approximately 260 μm (1.3 times of the width W10).

In the condition c2, the width W22 is formed to be approximately 0.7 times of the width W12, the width W32 is formed to be approximately 0.54 times of the width W12, and the depth DP is formed to be approximately 0.86 times of the width W12. For example, when the width at the opening part of the dent part CC2 along the first direction D1 (the width W10 of the dent part CC illustrated in FIG. 4) is 200 μm, the width W12 is approximately 440 μm (2.2 times of the width W10). In this case, the width W22 is approximately 310 μm (1.55 times of the width W10), the width W32 is approximately 240 μm (1.2 times of the width W10), and the depth DP is approximately 380 μm (1.9 times of the width W10).

In the condition c3, the width W22 is formed to be approximately 0.93 times of the width W12, the width W32 is formed to be approximately 0.68 times of the width W12, and the depth DP is formed to be approximately 0.57 times of the width W12. For example, when the width at the opening part of the dent part CC2 along the first direction D1 (the width W10 of the dent part CC illustrated in FIG. 4) is 200 μm, the width W12 is approximately 440 μm (2.2 times of the width W10). In this case, the width W22 is approximately 410 μm (2.05 times of the width W10), the width W32 is approximately 300 μm (1.5 times of the width W10), and the depth DP is approximately 300 μm (1.25 times of the width W10).

As stated above, it is possible to obtain the similar effect as the embodiment described in the above-stated FIG. 1 to FIG. 5 also in this embodiment.

Incidentally, an example is described in which one pixel is made up of three cells (red (R), green (G), and blue (B)) in the above-stated embodiments, but the present invention is not limited to the above. For example, one pixel may be made up of four or more cells. Otherwise, one pixel may be made up of cells generating colors other than red (R), green (G), and blue (B), or one pixel may includes cells generating colors other than red (R), green (G), and blue (B).

In the above-stated embodiments, an example is described in which the second direction D2 is in orthogonal to the first direction D1. The present invention is not limited to the embodiments. For example, the second direction D2 may intersect with the first direction D1 in an approximately orthogonal direction (for example 90 degrees±5 degrees). It is possible to obtain the similar effect as the above-stated embodiments also in this case.

Figure 9:
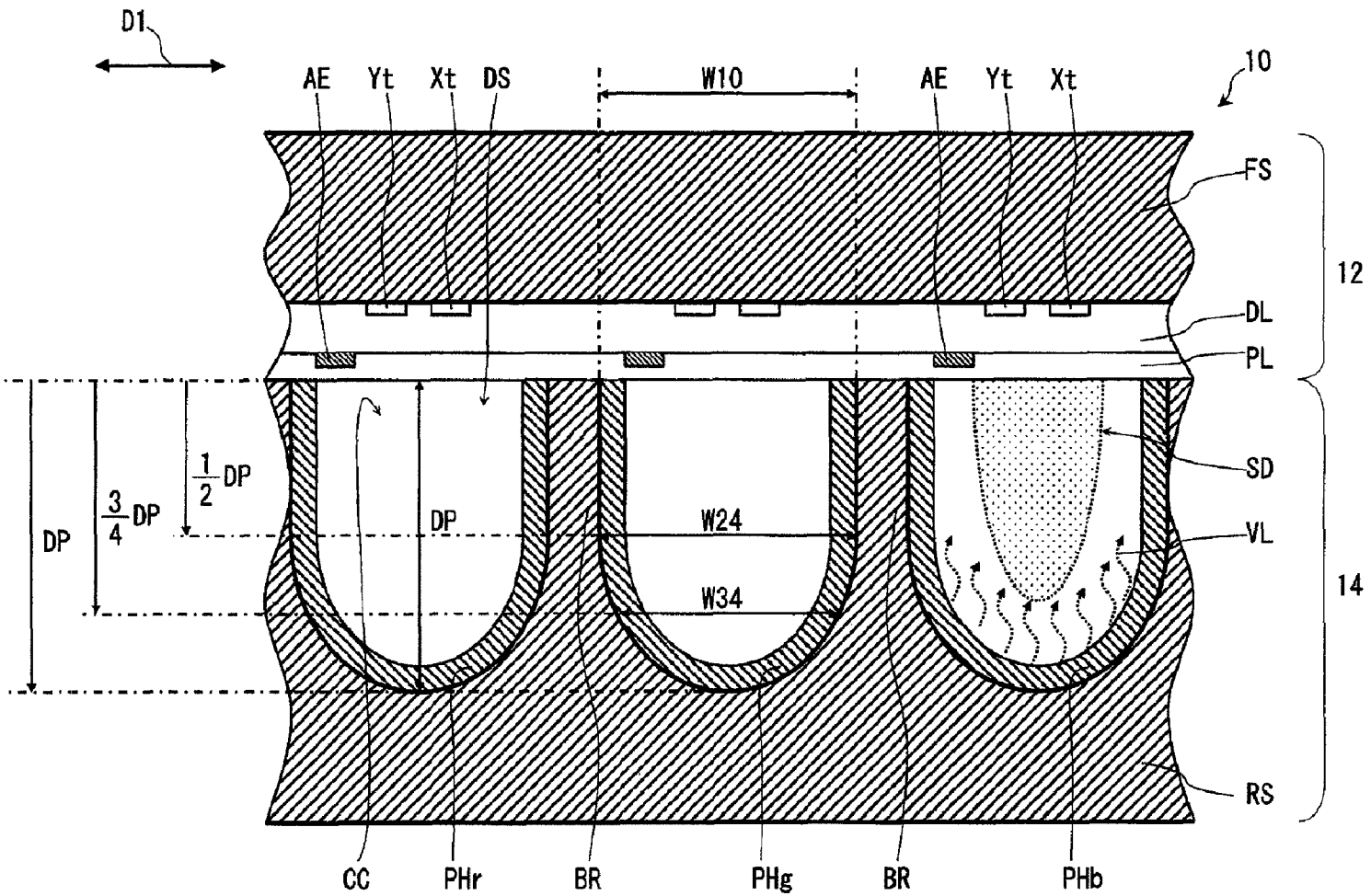
FIG. 9 is a view illustrating a cross section of the PDP illustrated in FIG. 1 along a first direction in a modification example.

In the above-stated embodiments, an example is described in which the width of the dent part CC along the first direction D1 is formed to be narrower as it goes from the opening part to the bottom part. The present invention is not limited to the embodiments. For example, a width W24 at a half of the depth of the dent part CC (½·DP) may be the same as the width W10 at the opening part of the dent part CC as illustrated in FIG. 9. In this case, the width of the dent part CC along the first direction D1 is formed to be narrower as it goes from the glass base FS side to the glass base RS side within a range from a position at the half of the depth DP (½·DP) to the bottom part of the dent part CC. It is possible to obtain the similar effect as the above-stated embodiments also in this case.

FIG. 9 illustrates a cross section of the PDP 10 illustrated in the above-stated FIG. 1 along the first direction D1 in a modification example. Incidentally, FIG. 9 illustrates the cross section at a position where the X transparent electrodes Xt and the Y transparent electrodes Yt face with each other (the cross section between the bus electrode Xb and the bus electrode Yb paired with each other). In the PDP 10 in FIG. 9, a form of the dent part CC is different from the embodiment described in the above-stated FIG. 1 to FIG. 5. The other constitutions are the same as the embodiment described in the above-stated FIG. 1 to FIG. 5. The same reference numerals and symbols are used to designate the same and corresponding elements described in FIG. 1 to FIG. 5, and the detailed description thereof will not be given.

The width of the dent part CC along the first direction D1 is formed to be narrower as it goes from the glass base FS side to the glass base RS side within a range from a position at the half of the depth DP (½·DP) to the bottom part of the dent part CC. For example, the width W10 at the opening part of the dent part CC along the first direction D1 is the same as the width W24 at the half of the depth of the dent part CC (½·DP) along the first direction D1, and the width W24 is larger than a width W34 at a depth of three fourths of the dent part CC (¾·DP) along the first direction D1. Namely, in the example in FIG. 9, the cross section of the dent part CC along the first direction D1 is formed to be in U-shape. Note that the cross section of the bottom part of the dent part CC along the first direction D1 may be formed in a line state. It is possible to obtain the similar effect as the above-stated embodiments also in this case.

In the above-stated embodiments, an example is described in which the barrier rib BR is integrally formed with the glass base RS. The present invention is not limited to the embodiments. For example, the barrier rib BR may be formed by using a barrier rib material in paste state. In this case, at first, the barrier rib material in paste state is coated on the glass base RS, and it is dried. After that, the photo resists R10 illustrated in the above-stated FIG. 3 are provided on the barrier rib material. The barrier rib materials at the portions not covered by the photo resists R10 are removed by the sand blast and so on, and the barrier ribs BR and the dent parts CC are formed. It is possible to obtain the similar effect as the above-stated embodiments also in this case.

Figure 10:
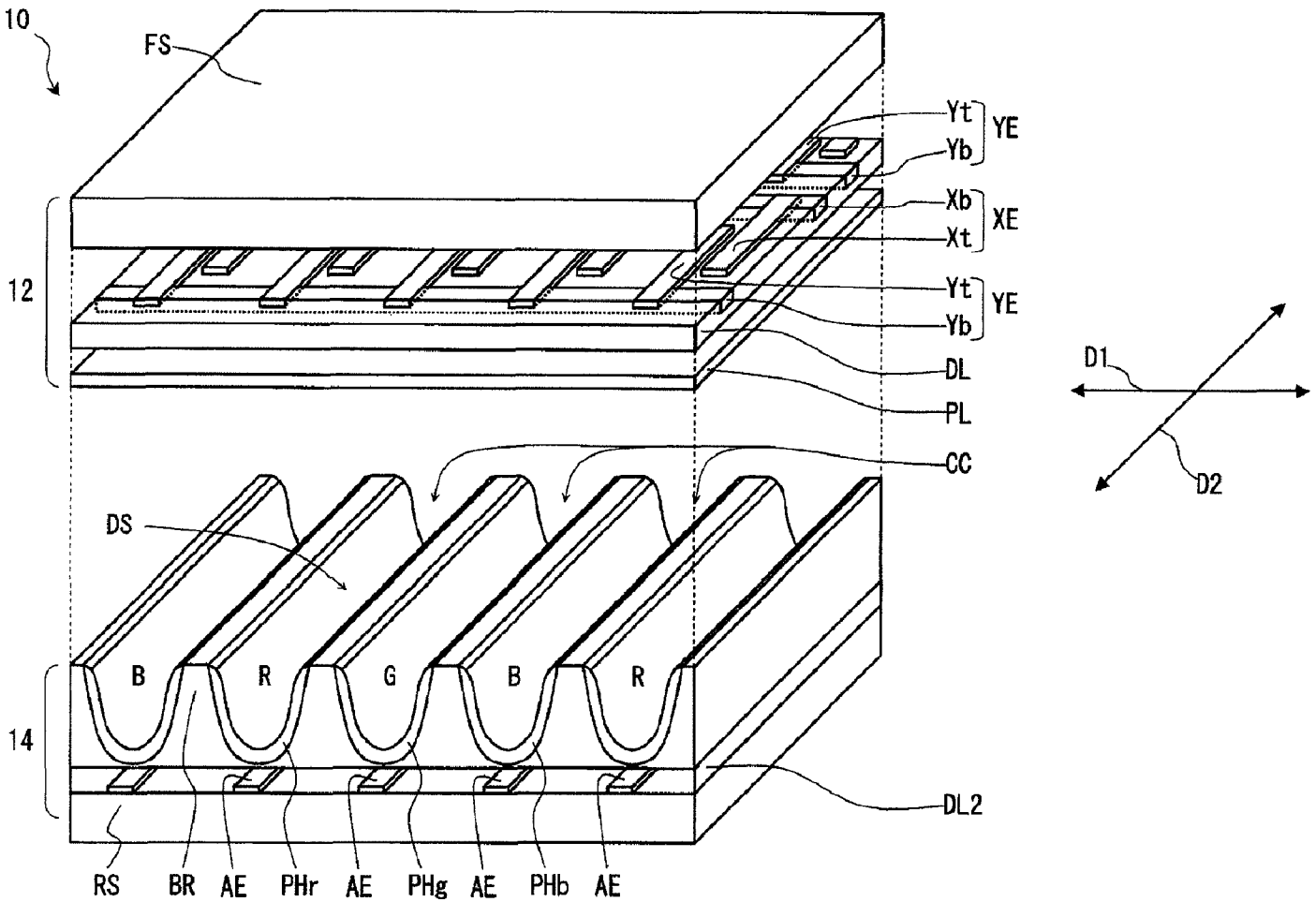
FIG. 10 is a view illustrating another modification example of the PDP illustrated in FIG. 1.

In the above-stated embodiments, an example is described in which the address electrodes AE are provided at the front plate part 12. The present invention is not limited to the embodiments. For example, the address electrodes AE may be provided at the back plate part 14 as illustrated in FIG. 10. In the constitution in FIG. 10, the plural address electrodes AE extending in the second direction D2 are provided on the glass base RS of the back plate part 14, and covered by a dielectric layer DL2. The barrier ribs BR are formed on the dielectric layer DL2.

In this case, at first, the barrier rib material in paste state is coated on the glass base RS and it is dried. After that, the photo resists R10 illustrated in the above-stated FIG. 3 are provided on the barrier rib material. The barrier rib material at the portions not covered by the photo resists R10 are removed by the sand blast and so on, and the barrier ribs BR and the dent parts CC are formed. It is possible to obtain the similar effect as the above-stated embodiments also in this case.

In the above-stated embodiments, an example is described in which the depth DP of the dent part CC is formed to be larger than the width W10 at the opening part of the dent part CC along the first direction D1. The present invention is not limited to the embodiments. For example, the depth DP of the dent part CC may be formed to be smaller than the width W10 at the opening part of the dent part CC along the first direction D1, or may be formed to be the same as the width W10. The luminescent efficiency can be improved compared to a PDP of which form inside the dent part is near the rectangle, also in this case. Accordingly, it is possible to obtain the similar effect as the above-stated embodiments also in this case.

The many features and advantages of the invention are apparent from the foregoing description. It is to be understood that the invention is not limited to the described embodiments, which are intended to be illustrative and not limiting. As will readily occur to those skilled in the art, numerous changes and modifications are possible in keeping with the principles and spirit of the invention, the scope of which is defined in the appended claims.

The invention claimed is:

1. A plasma display panel, comprising:

a first panel including a first plate provided with a plurality of display electrodes extending in a first direction; and a second panel including a second plate facing the first plate via a discharge space, wherein the second panel further includes a plurality of first barrier ribs arranged on the second plate along the first direction and extending in a second direction intersecting with the first direction, and a dent part opened to a side of the first plate between adjacent ones the first barrier ribs, the first panel includes a plurality of address electrodes provided on the first plate to extend in the second direction, the first barrier ribs are integrally formed with the second plate, a plurality of phosphors each emitting light of a different color with respect to each other and provided on a surface inside the dent part, and with respect to a width W1 at an opening part of the dent part along the first direction, a depth DP of the dent part ranges from 1.25×W1 to 1.9×W1, a width W2 at a half of the depth DP of the dent part along the first direction ranges from 0.7×W1 to 0.95×W1, and a width W3 at a depth of three-fourths of the depth DP of the dent part along the first direction ranges from 0.55×W1 to 0.7×W1.

2. The plasma display panel according to claim 1, wherein the width of the dent part along the first direction becomes narrower toward the bottom part from an opening part of the dent part.

3. The plasma display panel according to claim 1, wherein:

the second panel includes a plurality of second barrier ribs provided at the second plate to extend in the first direction and to divide the dent part; and a width of the dent part along the second direction becomes narrower as toward the side of the second plate from the side of the first plate for at least within the range from the position at the half of the depth to the bottom part of the dent part.

4. A manufacturing method of a plasma display panel having a first panel including a first plate provided with a plurality of display electrodes extending in a first direction, and a second panel including a second plate facing the first plate via a discharge space, in which the first panel includes a plurality of address electrodes provided on the first plate to extend in a second direction intersecting with the first direction, the manufacturing method comprising:

providing a plurality of first barrier ribs arranged on the second plate along the first direction and extending in the second direction; and providing a dent part opening to a side of the first plate between adjacent ones of the first barrier ribs of the second panel, wherein the first barrier ribs and the dent part are provided at the second panel by selectively removing the second plate, with respect to a width W1 at an opening part of the dent part along the first direction, a depth DP of the dent part is formed to be in a range of from 1.25×W1 to 1.9×W1, a width W2 at a half of the depth DP of the dent part along the first direction is formed to be in a range of from 0.7×W1 to 0.95×W1, and a width W3 at a depth of three-fourths of the depth DP of the dent part along the first direction is formed to be in a range of from 0.55×W1 to 0.7×W1, and a plurality of phosphors each emitting light of a different color with respect to each other and provided on a surface inside the dent part.

5. The manufacturing method of the plasma display panel according to claim 4, wherein the width of the dent part along the first direction is formed to be narrower toward the bottom part from an opening part of the dent part.

6. The manufacturing method of the plasma display panel according to claim 4, further comprising providing a plurality of second barrier ribs on the second plate extend in the first direction and divide the dent parts, wherein a width of the dent part along the second direction is formed to be narrower toward the side of the second plate from the side of the first plate for at least within the range from the position at the half of the depth to the bottom part of the dent part.

* * * * *